US008968427B2

(12) United States Patent
Eggenstein et al.

(10) Patent No.: US 8,968,427 B2
(45) Date of Patent: Mar. 3, 2015

(54) BLENDING FUELS

(75) Inventors: Matthias Eggenstein, Hamburg (DE); Andreas Hugo Brunner, Hamburg (DE)

(73) Assignee: Shell Oil Company, Houston, TX (US)

( * ) Notice: Subject to any disclaimer, the term of this patent is extended or adjusted under 35 U.S.C. 154(b) by 392 days.

(21) Appl. No.: 13/334,190

(22) Filed: Dec. 22, 2011

(65) Prior Publication Data

US 2012/0186143 A1 Jul. 26, 2012

(30) Foreign Application Priority Data

Dec. 24, 2010 (EP) ..... 10196964

(51) Int. Cl.

| | |
|---|---|
| ***C10L 1/18*** | (2006.01) |
| ***C10L 1/02*** | (2006.01) |
| ***C10L 1/14*** | (2006.01) |
| ***C10L 1/16*** | (2006.01) |
| ***C10L 1/19*** | (2006.01) |
| ***C10L 10/00*** | (2006.01) |

(52) U.S. Cl.

CPC . *C10L 1/026* (2013.01); *C10L 1/14* (2013.01); *C10L 1/143* (2013.01); *C10L 1/1616* (2013.01); *C10L 1/19* (2013.01); *C10L 10/00* (2013.01); *C10L 1/1658* (2013.01); *C10L 1/1641* (2013.01); *C10L 1/18* (2013.01); *C10L 2200/0438* (2013.01); *C10L 2200/0476* (2013.01); *C10L 2200/0492* (2013.01)

USPC ..... 44/388; 44/459

(58) Field of Classification Search

CPC ..... C10L 1/19; C10L 1/026; C10L 1/143; C10L 1/1633; C10L 1/165; C10L 1/1658

USPC ..... 44/388, 459

See application file for complete search history.

(56) References Cited

U.S. PATENT DOCUMENTS

| | | | | |
|---|---|---|---|---|
| 4,125,566 | A | 11/1978 | Trin Dinh et al. | |
| 4,478,955 | A | 10/1984 | Pesa et al. | |
| 2009/0241882 | A1* | 10/2009 | Brunner et al. | 123/1 A |

FOREIGN PATENT DOCUMENTS

| | | | |
|---|---|---|---|
| EP | 0147873 | A1 | 7/1985 |
| EP | 0583836 | B2 | 2/2002 |
| GB | 2077289 | A | 12/1981 |
| WO | 9712014 | A1 | 4/1997 |
| WO | 0027956 | A1 | 5/2000 |
| WO | 2007106346 | A2 | 9/2007 |
| WO | 2009118302 | A2 | 10/2009 |

OTHER PUBLICATIONS

Van Der Burgt et al., "The Shell Middle Distillate Synethesis Process", Petroleum Review, pp. 204-209,Apr. 1990.

PCT International Search Report, Application No. PCT/EP2011/073916 dated Feb. 1, 2012.

Stanciu I., "Study Solubility of Two Copolymers Used as Viscosity Improvers for Multi-Grade Oil", The Annals of "Dunarea De Jos", University of Galati, Fascicle V, Technologies in Machine Bldg., 2009, pp. 323-326.

* cited by examiner

*Primary Examiner* — Cephia D Toomer

(57) ABSTRACT

An additive composition for blending with fuel, the additive composition at least 3% w/w of a viscosity index (VI) improving polymer; and a solvent mixture including in the range of from 10 to 85% v/v of a middle distillate gas oil and at least 15% v/v of one or more components selected from aromatic hydrocarbons and oxygenates.

19 Claims, No Drawings

BLENDING FUELS

The present application claims the benefit of European Patent Application No. 10196964.0, filed Dec. 24, 2010, the entire disclosure of which is hereby incorporated by reference.

FIELD OF THE INVENTION

The present invention relates to viscosity index (VI) improving polymers. In particular, though not exclusively, the invention relates to the blending of VI improving polymers into fuel compositions, in particular diesel fuel compositions.

BACKGROUND OF THE INVENTION

In recent decades, the use of internal combustion engines, powered by the ignition of hydrocarbon fuel, for transportation and energy generation has become more and more widespread.

For example, compression ignition engines, which will be referred to further as "diesel" engines after Rudolf Diesel (who invented the first compression ignition engine in 1892) feature among the main type of internal combustion engines employed for passenger cars and heavy duty applications, as well as for stationary power generation, as a result of their high efficiency. In a diesel engine a fuel/air mixture is ignited by being compressed until it ignites due to the temperature increase resulting from compression.

It has been found that the addition of viscosity index (VI) improving additives to diesel fuel has significant benefits. WO2009/118302, for example, discloses the use of VI improving additives, in an automotive fuel composition, for the purpose of improving the acceleration performance of an internal combustion engine into which the fuel composition is or is intended to be introduced. The concentration of the VI improving additive may be up to 1% w/w, although optimum concentrations are said to be, for instance, between 0.05 and 0.5% w/w, or between 0.05 and 0.25% w/w, or between 0.1 and 0.2% w/w.

VI improving additives may be dosed (or added) directly into a fuel component or composition, for example at a refinery. Alternatively, VI improving additives may be pre-dissolved to form an additive composition or pre-blend, which is subsequently dosed into the fuel component or composition. Pre-dissolution has the advantage of leading to a more even distribution of the VI improving additive in the fuel. Furthermore, the blending of base fuel components may not be feasible at all locations, whereas the introduction of additive compositions, in relatively low amounts, can more readily be achieved at fuel depots or at other filling points such as road tanker, barge or train filling points, dispensers, customer tanks and vehicles.

WO2009/118302 suggests a number of examples of solvents that may be used to pre-dissolve VI improving additives in general, including certain fuel components and organic solvents.

Nevertheless, there remains a need for compositions and methods that facilitate the blending of VI improving additives, specifically VI improving polymers, into fuel in an effective and convenient manner.

SUMMARY OF THE INVENTION

Accordingly, in one embodiment, an additive composition for blending with fuel is provided comprising at least 3% w/w of a viscosity index (VI) improving polymer; and a solvent mixture comprising in the range of from 10 to 85% v/v of a middle distillate gas oil and at least 15% v/v of at least one component selected from aromatic hydrocarbons and oxygenates.

In another embodiment, a method of incorporating a VI improving polymer into a fuel composition is provided, the method comprising: mixing at least 3% w/w of a VI improving polymer with a solvent mixture including in the range of from 10 to 85% v/v of a middle distillate gas oil and at least 15% v/v of one or more components selected from aromatic hydrocarbons and oxygenates to form an additive composition; and blending the additive composition with the fuel composition.

In yet another embodiment, a fuel composition and additive composition package is provided comprising: a fuel composition having a fuel component concentration or concentration threshold associated therewith; and an additive composition comprising: a viscosity index (VI) improving additive and a solvent or solvent mixture including a concentration of the fuel component, wherein the concentration of the fuel component in the additive composition is no greater than the concentration or concentration threshold associated with the fuel component in the fuel composition.

DETAILED DESCRIPTION OF THE INVENTION

In an embodiment, an additive composition is provided for blending with fuel, the additive composition comprising: at least 3% w/w of a viscosity index (VI) improving polymer; and a solvent mixture including in the range of from 10 to 85% v/v (based on the total volume of the solvent mixture) of a middle distillate gas oil and at least 15% v/v (based on the total volume of the solvent mixture) of one or more components selected from aromatic hydrocarbons and oxygenates. The additive composition has been found to enable particularly effective and advantageous incorporation of VI improving polymers into fuel for a number of interlinked reasons.

Firstly, the fact that the additive composition comprises at least 3% w/w of the VI improving polymer ensures that the amount of the additive composition required to be dosed into fuel remains suitably low, thereby avoiding onerous handling of large quantities of the additive composition.

Secondly, compared to additive compositions employing middle distillate gas oil as sole solvent (as suggested in WO2009/118302), the additive composition of the invention has been found to mitigate the trade off between VI improving polymer concentration and viscosity. The fact that the additive composition comprises at least 15% v/v of one or more components selected from aromatic hydrocarbons and oxygenates, has been found to lead to a significant mitigation of viscosity increases, even in the presence of 10 to 85% v/v gas oil in the solvent mixture. This facilitates handling of the composition, e.g. without the need for heat input, and is of particular benefit because the composition comprises a relatively high concentration of VI improving polymer, as described above.

Thirdly, compared to an additive composition employing a component other than middle distillate gas oil as sole solvent, the additive composition of the invention is able to mitigate or prevent undesired concentration increases in middle distillate fuels to which it may be added. Fuels are typically required to comply with fuel specifications (e.g. EN 590) that set thresholds for the concentration of fuel components other than middle distillate gas oil. The presence of 10 to 85% v/v middle distillate gas oil reduces the impact of the additive composition on the concentration of components other than middle distillate gas oil in fuel to which the composition is added, thus allowing the additive composition to be blended into a wide range of fuels without affecting their compliance with fuel specifications.

In summary the additive composition of the invention thus comprises purposively selected components that, in combination, allow surprisingly effective and convenient incorporation of VI improving polymers into fuel by facilitating the handling of the composition (in terms of requisite amount and viscosity) and by mitigating or preventing undesired concentration increases in the fuel.

The middle distillate gas oil in the solvent mixture comprises liquid hydrocarbons and may typically have a boiling point (EN ISO 3405) within the usual diesel range of 150 to 410° C. or 170 to 370° C., depending on grade and use.

In general middle distillate gas oil may be organically or synthetically derived. A petroleum derived gas oil may for instance be obtained by refining and optionally (hydro) processing a crude petroleum source.

It may be a single gas oil stream obtained from such a refinery process or a blend of several gas oil fractions obtained in the refinery process via different processing routes. Examples of such gas oil fractions are straight run gas oil, vacuum gas oil, gas oil as obtained in a thermal cracking process, light and heavy cycle oils as obtained in a fluid catalytic cracking unit and gas oil as obtained from a hydrocracker unit. Optionally a petroleum derived middle distillate gas oil may comprise petroleum derived kerosene fraction. Typically, petroleum derived gas oil will include one or more cracked products, obtained by splitting heavy hydrocarbons.

The gas oil may also be or comprise a Fischer-Tropsch derived gas oil. In the context of the present invention, the term "Fischer-Tropsch derived" means that a material is, or derives from, a synthesis product of a Fischer-Tropsch condensation process. The term "non-Fischer-Tropsch derived" may be interpreted accordingly. A Fischer-Tropsch derived gas oil or fuel component will therefore be a hydrocarbon stream in which a substantial portion, except for added hydrogen, is derived directly or indirectly from a Fischer-Tropsch condensation process.

The Fischer-Tropsch reaction converts carbon monoxide and hydrogen into longer chain, usually paraffinic, hydrocarbons in the presence of an appropriate catalyst and typically at elevated temperatures (e.g. 125 to 300° C., preferably 175 to 250° C.) and/or pressures (e.g. 0.5 to 10 MPa, preferably 1.2 to 5 MPa). Hydrogen to carbon monoxide ratios other than 2:1 may be employed if desired. The carbon monoxide and hydrogen may themselves be derived from organic, inorganic, natural or synthetic sources, typically either from natural gas or from organically derived methane.

A Fischer-Tropsch derived gas oil of use in the present invention may be obtained directly from the refining or the Fischer-Tropsch reaction, or indirectly for instance by fractionation or hydrotreating of the refining or synthesis product to give a fractionated or hydrotreated product. Hydrotreatment can involve hydrocracking to adjust the boiling range (see e.g. GB-B-2077289 and EP-A-0147873) and/or hydroisomerisation, which can improve cold flow properties by increasing the proportion of branched paraffins. EP-A-0583836 describes a two-step hydrotreatment process in which a Fischer-Tropsch synthesis product is firstly subjected to hydroconversion under conditions such that it undergoes substantially no isomerisation or hydrocracking (this hydrogenates the olefinic and oxygen-containing components), and then at least part of the resultant product is hydroconverted under conditions such that hydrocracking and isomerisation occur to yield a substantially paraffinic hydrocarbon fuel or gas oil. The desired fraction(s), typically gas oil fraction(s), may subsequently be isolated for instance by distillation.

Other post-synthesis treatments, such as polymerisation, alkylation, distillation, cracking-decarboxylation, isomerisation and hydroreforruing, may be employed to modify the properties of Fischer-Tropsch condensation products, as described for instance in U.S. Pat. No. 4,125,566 and U.S. Pat. No. 4,478,955. Typical catalysts for the Fischer-Tropsch synthesis of paraffinic hydrocarbons comprise, as the catalytically active component, a metal from Group VIII of the periodic table of the elements, in particular ruthenium, iron, cobalt or nickel. Suitable such catalysts are described for instance in EP-A-0583836.

An example of a Fischer-Tropsch based process is the Shell™ "Gas-to-liquids" or "GtL" technology (formerly known as the SMDS (Shell Middle Distillate Synthesis) and described in "The Shell Middle Distillate Synthesis Process", van der Burgt et al, paper delivered at the 5$^{th}$ Synfuels Worldwide Symposium, Washington D.C., November 1985, and in the November 1989 publication of the same title from Shell International Petroleum Company Ltd, London, UK). In the latter case, preferred features of the hydroconversion process may be as disclosed therein. This process produces middle distillate range products by conversion of a natural gas into a heavy long chain hydrocarbon (paraffin) wax, which can then be hydroconverted and fractionated.

For use in the present invention, a Fischer-Tropsch derived middle distillate gas oil is preferably any suitable fuel component derived from a gas to liquid synthesis (hereinafter a GtL component), or a component derived from an analogous Fischer-Tropsch synthesis, for instance converting gas, biomass or coal to liquid (hereinafter an XtL component). A Fischer-Tropsch derived component is preferably a GtL component. It may be a BtL (biomass to liquid) component. In general a suitable XtL component may be a middle distillate fuel component, for instance selected from kerosene, diesel and gas oil fractions as known in the art; such components may be generically classed as synthetic process fuels or synthetic process oils.

Middle distillate gas oil components for use in the solvent mixture of the composition according to the present invention will typically have a density in the range of from 750 to 900 kg/m$^3$, preferably from 800 to 860 kg/m$^3$, at 15° C. (EN ISO 3675) and/or a kinematic viscosity at 40° C. (VK40) of from 1.0, e.g. 1.5, to 6.0 mm$^2$/s (VK 40° C. as measured by EN ISO 3104). Preferably the VK40 is in the range of from 1.0 to 3.0 mm$^2$/s, more preferably from 1.5 to 2.5 or 2.7 mm$^2$/s; all as measured according to EN ISO 3104).

The gas oil component may preferably contain no more than 5000 ppmw (parts per million by weight) of sulphur, typically from 2000 to 5000 ppmw, or from 1000 to 2000 ppmw, or alternatively up to 1000 ppmw. The composition may, for example, contain at most 500 ppmw, preferably no more than 350 ppmw, most preferably no more than 100 or 50 or even 10 ppmw, of sulphur. The sulphur content may be measured according to EN ISO 20884.

Gas oil may be processed in a hydrodesulphurisation (HDS) unit so as to reduce its sulphur content to a level suitable for inclusion in a diesel fuel composition.

The aromatics content of the middle distillate gas oil may preferably be in the range of from 0 to 40% m/m, suitably from 5 to 30% m/m, for example in the range of 10 to 20% m/m. More preferably the aromatics content is in the range of from 10 to 35% m/m, even more preferably from 15 to 30% m/m, and especially from 20 to 30% m/m. The middle distillate aromatics content may be measured according to IP391 and EN12916.

Particularly suitable middle distillate gas oil components that provide a useful lowered viscosity of the additive composition of the present invention when used in the solvent mixture, have the properties of a low VK40 in combination with a high aromatics content. Thus particularly useful gas oils have a VK40 in the range of from 1.0 to 3.0 $mm^2/s$, more preferably 1.5 to 2.7, or to 2.5, $mm^2/s$, when measured by EN ISO 3104, and an aromatics content in the range of from 10 to 35% m/m, more preferably 15 to 30% m/m, and especially 20 to 30% m/m, when measured by IP391 or EN12916.

The middle distillate gas oil may comprise a mixture of two or more components of the types described above.

Based on the total volume of the solvent mixture, the middle distillate gas oil component may preferably be present in an amount in the range of from 20 to 80% v/v, more preferably 30 to 75% v/v, even more preferably 40 to 70% v/v, and most preferably 50 to 65% v/v. Thus the solvent mixture may preferably comprise at least 20% v/v, more preferably at least 30% v/v, even more preferably at least 40% v/v and most preferably at least 50% v/v middle distillate gas oil. Additionally or alternatively, it may preferably comprise at most 80% v/v, more preferably at most 75% v/v, even more preferably at most 70% v/v, and most preferably at most 65% v/v middle distillate gas oil. A high volume of gas oil in the solvent mixture helps to mitigate or prevent undesired concentration increases in middle distillate fuels to which the additive composition may be added. Preferably, the middle distillate gas oil may be a middle distillate fuel component of a fuel to which the additive composition is or is to be added.

To enhance solubility of the VI improving polymer, the solvent mixture of the additive composition further comprises one or more components selected from aromatic hydrocarbons and oxygenates.

Aromatic hydrocarbons of use as an aromatic hydrocarbons component in the solvent mixture according to the invention include all aromatic hydrocarbons suitable for blending into fuel, preferably diesel fuel. Conveniently, the aromatic hydrocarbon component may be provided as an aromatic stream, e.g. a refinery product stream, with an aromatic hydrocarbon content exceeding 80% m/m, preferably 90% m/m, most preferably 98% m/m. The content may be determined by test method IP391 or EN12916. Preferably, the aromatic hydrocarbon component may consist essentially of aromatic hydrocarbons, which may be obtained, for example, by fractionation/extraction from refinery product streams as is known in the art. The aromatic hydrocarbons may have any suitable number of carbon atoms, although C9-C11 hydrocarbons are preferred.

The aromatic hydrocarbon component may preferably have a boiling point and/or density and/or flash point comparable with middle distillate gas oils. Thus, the aromatic hydrocarbon component may advantageously have a boiling point (ASTM D1078) within the range of 150 to 410° C., preferably 170 to 370° C., more preferably 180 to 250° C. The density of the aromatic hydrocarbon component may preferably be in the range of from 750 to 1200 $kg/m^3$, more preferably from 800 to 900 $kg/m^3$ (at 15° C. ASTM D4052). Its flash point (ASTM D-93) may preferably lie above 55° C.

Advantageously, the aromatic hydrocarbon component may have a viscosity at 40° C. (ASTM D445 or EN ISO 3104) below 2 $mm^2/s$. Suitably the viscosity of the aromatic hydrocarbon component, when mixed with 3% w/w of a VI improving polymer used in the additive composition, may remain below 20 $mm^2/s$, preferably below 10 $mm^2/s$ at 40° C. (VK 40° C. as measured by EN ISO 3104).

The aromatic hydrocarbon component may preferably contain at most 500 ppmw, preferably at most 350 ppmw, most preferably at most 100 or 50 or even 5 ppmw, of sulphur (Shell Method Series 1897). Additionally or alternatively the aromatic hydrocarbon component may contain at most 50 ppmw, preferably at most 30 ppmw, most preferably at most 20 or 10 or even 5 ppmw, of benzene (determined by gas chromatography).

An example of a particularly preferred aromatic hydrocarbon component is ShellSol A150 (available ex. Shell companies), which is a stream of C9-11 hydrocarbons with an aromatics content exceeding 99% v/v (i.e. consisting essentially of C9-11 aromatic hydrocarbons).

Alternative hydrocarbon components are toluene and xylene.

Based on the total volume of the solvent mixture, an aromatic hydrocarbon component may preferably be present in an amount in the range of from 5 to 90% v/v, more preferably 15 to 60% v/v, even more preferably 25 to 50% v/v, and most preferably 30 to 40% v/v. Thus the solvent mixture may preferably comprise at least 5% v/v, more preferably at least 15%, even more preferably at least 25% v/v and most preferably at least 30% v/v aromatic hydrocarbon component. Additionally or alternatively, the solvent mixture may preferably comprise at most 90% v/v, more preferably at most 60% v/v, even more preferably at most 50% v/v, and most preferably at most 40% v/v aromatic hydrocarbon component. A high concentration of aromatic hydrocarbon component in the solvent mixture has been found to help keep the viscosity of the additive composition low. As aforesaid, a certain amount of aromatic hydrocarbons may also be present in the middle distillate gas oil component. Suitable and preferred overall aromatic hydrocarbon contents of the solvent mixture may be calculated accordingly.

Oxygenates of use as an oxygenate component in the solvent mixture according to the invention include any oxygenates suitable for blending into fuel, preferably diesel fuel. Oxygenates contain oxygen in their structure which influences their physicochemical properties, including their solvent properties. In accordance with the invention, oxygenates may preferably contain only carbon, hydrogen and oxygen.

One advantage associated with an oxygenate component in the solvent mixture is that it allows the incorporation of bio-derived material into the additive composition. Thus the solvent mixture may preferably comprise an oxygenate component derived from organic material, as in the case of currently available bio-derived fuels such as vegetable oils and their derivatives. The oxygenate component may advantageously comprise at least about 0.1 dpm/gC of carbon-14. It is known in the art that carbon-14 (C-14), which has a half-life of about 5,700 years, is found in organic material-derived oxygenates but not in fossil fuels.

Advantageously, the oxygenate component may contribute to enhancing the solubility of the VI improving polymer. Oxygenates of use as the oxygenate component may suitably be compounds containing one or more ether groups —O—, and/or one or more ester groups —C(O)O—, and/or one or more carbonyl groups C═O, and optionally one or more hydroxyl groups —OH. They may preferably contain from 1 to 18 carbon atoms and in certain cases from 1 to 10 carbon atoms.

The oxygenate component may preferably comprise or consist of a non-protic or aprotic solvent.

Oxygenates comprising one or more ether and/or ester groups are particularly preferred since it has been found that ethers and esters are particularly effective in solubilising VI improving polymers.

Conveniently, the oxygenate component may be provided as an oxygenate stream with an oxygenate content exceeding 80% v/v, preferably 90% v/v, most preferably 98% v/v. Preferably, the oxygenate component may essentially consist of oxygenate.

The oxygenate component may preferably have a boiling point (ASTM D1078) in the range of from 100 to 360° C., more preferably from 250 to 290° C. Its density may suitably be in the range of from 750 to 1200 kg/m$^3$, preferably from 800 to 900 kg/m$^3$ (EN ISO 12185). Its flash point (EN ISO 2719) may preferably lie above 55° C., more preferably above 100° C.

Advantageously, the oxygenate component may have a viscosity at 40° C. (VK 40° C. as measured by EN ISO 3104) below 6 mm$^2$/s. Suitably the viscosity of the oxygenate, when mixed with 5% w/w of a VI improving polymer used in the additive composition, may remain below 75 mm$^2$/s, preferably below 50 mm$^2$/s at 40° C. (VK 40° C. as measured by EN ISO 3104).

The oxygenate component may preferably contain no more than 500 mg/kg, more preferably no more than 100 mg/kg, most preferably no more than 15 mg/kg sulphur (EN ISO 20884).

Particularly preferred oxygenates of use in the present invention are esters, for example alkyl (preferably C1 to C8 or C1 to C5, such as methyl or ethyl) esters of carboxylic acids or of (optionally hydrogenated) vegetable oils. The carboxylic acid in this case may, for example, be an optionally substituted, straight or branched chain, mono-, di- or multi-functional C1 to C6 carboxylic acid, typical substituents including hydroxy, carbonyl, ether and ester groups. Preferred examples of oxygenates include succinates and levulinates, fatty acid alkyl esters (FAAE), and in particular fatty acid methyl esters (FAME).

Ethers are also usable in or as oxygenate components in accordance with the invention, for example dialkyl (typically C1 to C6) ethers such as dibutyl ether and dimethyl ether.

Based on the total volume of the solvent mixture, an oxygenate component may preferably be present in an amount in the range of from 1 to 90% v/v, more preferably 2 to 60% v/v, even more preferably 3 to 25% v/v, and most preferably 4 to 10% v/v. Thus the solvent mixture may preferably comprise at least 1% v/v, more preferably at least 2%, even more preferably at least 3% v/v and most preferably at least 4% v/v of the oxygenate component. Additionally or alternatively, the solvent mixture may preferably comprise at most 90% v/v, more preferably at most 60% v/v, even more preferably at most 25% v/v, and most preferably at most 10% v/v of the oxygenate component. A high volume of the oxygenate component in the solvent mixture helps to enhance the solubility of the VI improving polymer.

To enable dosing of the additive composition into fuel comprising oxygenate(s) at, or close to, a threshold level, set for example by a specification (e.g. EN 590), the oxygenate component may preferably be present in the solvent mixture at a concentration less than or equal to a concentration or concentration threshold of oxygenate(s) in a fuel to which the additive composition is or is to be added. In this manner, an increase in the concentration of oxygenate(s) in the fuel is avoided.

The VI improving polymer of the additive composition may advantageously comprise a copolymer that contains one or more olefin monomers (or monomer blocks), typically selected from ethylene, propylene, butylene, butadiene, isoprene and styrene monomers.

The VI improving polymer may preferably be a block copolymer. It may advantageously comprise aromatic monomer units. Most preferably, the VI improving polymer may be selected from styrene-based copolymers, in particular block copolymers, for example those available as Kraton™ D or Kraton™ G additives (ex. Kraton) or as SV™ additives (ex. Infineum, Multisol or others). Particular examples include copolymers of styrenic and ethylene/butylene monomers, for instance polystyrene-polyisoprene copolymers and polystyrene-polybutadiene copolymers. Such copolymers may be block copolymers, as for instance SV™ 150 (a polystyrene-polyisoprene di-block copolymer) or the Kraton™ additives (styrene-butadiene-styrene tri-block copolymers or styrene-ethylene-butylene block copolymers). They may be tapered copolymers, for instance styrene-butadiene copolymers. They may be stellate copolymers, as for instance SV™ 260 (a styrene-polyisoprene star copolymer) or SV™ 200 (a divinylbenzene-polyisoprene star copolymer).

It has been found that the solvent mixture is particularly suited to mitigating viscosity increases in additive compositions comprising a VI improving polymer that can self assemble to form star-shaped supra-molecular structures (micelles) in solution, particularly at low temperatures. An example of such a polymer is SV™ 150 (a polystyrene-polyisoprene di-block copolymer).

The VI improving polymer may additionally or alternatively comprise other block copolymers based on ethylene, butylene, butadiene, isoprene or other olefin monomers, for example ethylene-propylene copolymers; polyisobutylenes (PIBs); polymethacrylates (PMAs); poly alpha olefins (PAOs); and mixtures thereof.

The kinematic viscosity at 40° C. (VK 40, as measured by EN ISO 3104) of the VI improving polymer may preferably be 700 mm$^2$/s or greater, more preferably 1000 mm$^2$/s or greater. Indeed the VI improving polymer may be a solid at 40° C. Its density at 15° C. (EN ISO 3675) may suitably be 600 kg/m$^3$ or greater, preferably 800 kg/m$^3$ or greater. Its sulphur content (EN ISO 20846) may suitably be 1000 mg/kg or lower, preferably 350 mg/kg or lower, more preferably 10 mg/kg or lower.

VI improving polymer(s) may preferably be present in the additive composition in an amount in the range of from 3 to 25% w/w, more preferably 4 to 20% w/w, even more preferably 5 to 15% w/w, and most preferably 7 to 12% w/w or even 9% to 11% w/w based on the total weight of the additive composition. Thus the additive composition may preferably comprise at least 4% w/w, more preferably at least 5% w/w, even more preferably at least 7% w/w and most preferably at least 9% w/w VI improving polymer. Additionally or alternatively, the additive composition may comprise at most 25% w/w, more preferably at most 20% w/w, even more preferably at most 15% w/w, and most preferably at most 12% w/w or even 11% w/w VI improving polymer.

To facilitate handling, for example by pumps, the kinematic viscosity at 40° C. (VK 40° C. as measured by EN ISO 3104) of the additive composition may advantageously be at most 1000 mm$^2$/s, preferably at most 600 mm$^2$/s, more preferably at most 400 mm$^2$/s, and even more preferably at most 300 mm$^2$/s, such as for example at most 100 mm$^2$/s or even at most 50 mm$^2$/s.

In one particularly preferred embodiment of the invention, the additive composition comprises in the range of from 5 to 15% w/w of a viscosity index (VI) improving polymer, particularly a copolymer including an aromatic monomer, and a solvent mixture including: in the range of from 40 to 70% v/v of a middle distillate gas oil, in the range of from 25 to 50% v/v aromatic hydrocarbons, and in the range of from 5 to 10% v/v fatty acid alkyl ester.

The additive composition may comprise other fuel additives. The one or more other fuel additives may be selected from any useful additive, such as detergents, anti-corrosion additives, esters, poly-alpha olefins, long chain organic acids, components containing amine or amide active centres, and mixtures thereof.

The additive composition may contain any number of additional useful additives known to the person of skill in the art. In some embodiments, two or more viscosity increasing components may be used, such as a VI improving polymer and a high viscosity fuel or oil component. In another embodiment there may be two or more VI improving polymers of the same or different structural class.

Some advantages of the invention are applicable irrespective of the minimum amount of VI polymer content in the composition. Thus, from a second aspect, the invention resides in an additive composition for blending with fuel, the additive composition comprising an amount of a viscosity index (VI) improving polymer; and a solvent mixture including in the range of from 10 to 85% v/v of a middle distillate gas oil and at least 15% v/v of one or more components selected from aromatic hydrocarbons and oxygenates.

The additive composition may be useful for incorporating a VI improving polymer into a fuel, such as a diesel fuel. Further it may be useful for avoiding a concentration increase in the fuel of at least one fuel component, such as, for example an oxygenate as defined anywhere herein. The fuel may advantageously be an automotive fuel.

In another embodiment, a method of blending or incorporating a VI improving polymer into a fuel composition is provided by mixing at least 3% w/w of a VI improving polymer with a solvent mixture including in the range of from 10 to 85% v/v of a middle distillate gas oil and at least 15% v/v of one or more components selected from aromatic hydrocarbons and oxygenates to form an additive composition; and blending the additive composition with fuel.

Preferably, the method may comprise blending in the range of from 0.25 to 5% v/v, more preferably 0.5 to 1.5% v/v of the additive composition with the fuel.

Advantageously, the fuel composition and the additive composition may each comprise a concentration of a fuel component, such as an oxygenate as defined anywhere herein, with the concentration of the fuel component in the additive being less than or equal to the concentration of the fuel component in the fuel.

The fuel composition and additive composition package contains a fuel composition having a fuel component concentration or concentration threshold associated therewith; and an additive composition comprising: a viscosity index (VI) improving additive and a solvent or solvent mixture including a concentration of the fuel component, wherein the concentration of the fuel component in the additive composition is no greater than the concentration or concentration threshold associated with the fuel component in the fuel composition. The fuel component may preferably be an oxygenate as defined anywhere herein.

Throughout the description and claims of this specification, the words "comprise" and "contain" and variations of the words, for example "comprising" and "comprises", mean "including but not limited to", and do not exclude other moieties, additives, components, integers or steps.

Throughout the description and claims of this specification, the singular encompasses the plural unless the context otherwise requires. In particular, where the indefinite article is used, the specification is to be understood as contemplating plurality as well as singularity, unless the context requires otherwise. Preferred features of each aspect of the present invention may be as described in connection with any of the other aspects. Other features of the present invention will become apparent from the following examples.

Generally speaking the invention extends to any novel one, or any novel combination, of the features disclosed in this specification (including any accompanying claims and drawings). Thus, features, integers, characteristics, compounds, chemical moieties or groups described in conjunction with a particular aspect, embodiment or example of the present invention are to be understood to be applicable to any other aspect, embodiment or example described herein unless incompatible therewith. Moreover, unless stated otherwise, any feature disclosed herein may be replaced by an alternative feature serving the same or a similar purpose.

The following examples illustrate solvent mixtures and additive compositions in accordance with the present invention and assess their effectiveness in dissolving and incorporating VI improving polymers into fuel.

COMPONENTS USED IN THE EXAMPLES

The following components were used in the following Examples.

VI Improving Polymers:

SV 150™, a polystyrene-polyisoprene di-block copolymer, ex. Infineum

SV 260™, a styrene-polyisoprene star copolymer, ex. Infineum

Gas Oils:

Petroleum derived middle distillate gas oil (Diesel) obtained from Shell, having an estimated aromatics content of about 20% m/m and the properties shown in Table 1:

TABLE 1

| | | |
|---|---|---|
| Density @ 15° C. | DIN EN ISO 12185 | 839.4 kg/m$^3$ |
| Viscosity @ 40° C. | DIN EN ISO 3104 | 2.63 mm$^2$/s |
| Distillation, IBP | DIN EN ISO 3405 | 175° C. |
| Distillation, DP | DIN EN ISO 3405 | 353° C. |
| Sulphur | DIN EN ISO 20884 | 6 mg/kg |
| Flashpoint | DIN EN ISO 2719 | 72° C. |
| CFPP | DI EN 116 | −16° C. |
| Cloud Point | DIN EN 23015 | −10 |

Fischer-Tropsch derived middle distillate gas oil (GTL) obtained from Shell and having the properties shown in Table 2:

TABLE 2

| | | |
|---|---|---|
| Density @ 15° C. | DIN EN ISO 12185 | 776.1 kg/m$^3$ |
| Viscosity @ 40° C. | DIN EN ISO 3104 | 2.46 mm$^2$/s |
| Distillation, IBP | DIN EN ISO 3405 | 203° C. |
| Distillation, DP | DIN EN ISO 3405 | 314° C. |
| Sulphur | DIN EN ISO 20884 | <5 mg/kg |
| Flashpoint | DIN EN ISO 2719 | 89° C. |

Aromatic Hydrocarbons:

ShellSol A150, ex. Shell. A mixture of aromatic chemicals in the range of C9-C10 having the properties shown in Table 3.

TABLE 3

| | | |
|---|---|---|
| Density @ 15° C. | ASTM D4052 | 893 kg/m$^3$ |
| Viscosity @ 40° C. | ASTM D445 | 1.2 mm$^2$/s |
| Distillation, IBP | ASTM D1078 | 183° C. |
| Distillation, DP | ASTM D1078 | 209° C. |
| Benzene | GC | <3 mg/kg |
| Sulphur | SMS 1897 | <0.5 mg/kg |
| Flashpoint | ASTM D-93 | 62-65° C. |

Oxygenates:

Fatty acid methyl esters (FAME) in the form of rapeseed methyl ester (RME) soy methyl ester (SME) and tallow methyl ester (TME) obtained from ADM and having the properties shown in Table 4:

TABLE 4

| | | RME | SME |
|---|---|---|---|
| Density @ 15° C. | DIN EN ISO 12185 | 882.9 kg/m$^3$ | 3884.9 kg/m$^3$ |
| Viscosity @ 40° C. | DIN EN ISO 3104 | 4.5 mm$^2$/s | n.d. |
| Sulphur | DIN EN ISO 20884 | <10 mg/kg | <10 mg/kg |
| Flashpoint | DIN EN ISO 2719 | >120° C. | >120° C. |
| CFPP | DIN EN ISO 116 | −17 | −3 |

Mixing Procedure

In each of the following Examples the VI improving polymers were weighted into a glass bottle and the designated amount of solvent was added. Repetitive cycles of swelling and stirring were conducted at 25° C. until all material was dissolved and a homogeneous solution was obtained.

EXAMPLE 1

Solubility of VI Improving Polymers in Gas Oil or Aromatic Hydrocarbons

The solubility of 5% w/w of SV 150™ and SV 260™ was tested in each of petroleum derived middle distillate gas oil, Fischer-Tropsch derived middle distillate gas oil and ShellSol A150.

Following mixing in the proportions shown in Table 5, the kinematic viscosity at 40° C. (VK 40, as measured by EN ISO 3104) and 100° C. (VK 100, as measured by EN ISO 3104) of the compositions was determined. The results are shown in Table 5.

TABLE 5

| | | Viscosity (mm$^2$/s) at | |
|---|---|---|---|
| VII | Solvent | 40° C. | 100° C. |
| SV 150 | GTL | Not measurable, with standard method - too high | Not measurable, with standard method - too high |
| | Shellsol A150 | 12.065 | 5.3861 |
| | Diesel | Not measurable, with standard method | 16.103 |
| SV 260 | GTL | 124.31 | 33.63 |
| | Shellsol A150 | 68.937 | 25.611 |
| | Diesel | 195.54 | 49.775 |

The VKs of SV 150™ in GTL and petroleum derived middle distillate gas oil (at 40° C.) were not measureable with standard methods due to the high viscosity of these compositions. This could be due to the tendency of the polymers to conglomerate and build up larger molecule clusters/micelles, which have much higher impact on viscosity.

Dissolution of SV 150™ and SV 260™ in the aromatic mixture ShellSol A150 leads to a fully pourable mixture with rather low viscosity at 40° C.

EXAMPLE 2

Solubility of VI Improving Polymer in Oxygenate

The solubility of varying concentrations of SV 150™ was tested in an oxygenate, namely fatty acid methyl ester (FAME), specifically rapeseed methyl ester (RME), soy methyl ester (SME) and tallow methyl ester (TME).

Following mixing in the proportions shown in Table 6, the kinematic viscosity at 40° C. (VK 40, as measured by EN ISO 3104) of the compositions was determined. The results are shown in Table 6.

TABLE 6

| FAME | Concentration (% w/w) | VK40 (mm$^2$/s) |
|---|---|---|
| RME | 1.5 | 9.108 |
| RME | 2.5 | 21.13 |
| RME | 5.0 | 41.88 |
| RME | 7.5 | 117.9 |
| RME | 10.0 | 327.7 |
| SME | 10.0 | 248.4 |
| TME | 10.0 | 240.8 |

Mainly rapeseed methyl ester (RME) was investigated. The VK40 rises exponentially with increasing concentration of SV 150™. This observation might be explained with the build up of cross-linked networks or micelles in the solution, which induce stronger thickening.

Up to 10% w/w VI polymer can be dissolved into RME, whilst VK40 is still in the range of up to about 300 mm$^2$/s. When other types of FAME like SME (soy methyl ester) or TME (tallow methyl ester) are used, the VK40 remains below 300 mm$^2$/s at 10% w/w SV150™.

Therefore all FAME types were suitable for preparing preblends, with RME showing the highest viscosity in the preblend.

EXAMPLE 3

Solubility of VI Improving Polymer in Gas Oil in Combination with Aromatic Hydrocarbons The solubility of 5% w/w of SV 150™ was tested in solvent mixtures comprising ShellSol A150 and varying amounts of petroleum derived middle distillate gas oil or Fischer-Tropsch derived middle distillate gas oil (GTL).

Following mixing in the proportions shown in Table 7, the kinematic viscosity at 40° C. (VK 40, as measured by EN ISO 3104) and 100° C. (VK 100, as measured by EN ISO 3104) of the compositions was determined. The results are shown in Table 7.

TABLE 7

| ShellSol A150 | Petroleum derived MD | GTL | Viscosity (mm$^2$/s) | |
|---|---|---|---|---|
| (% v/v) | Gas Oil(% v/v) | (% v/v) | 40° c. | 100° C. |
| 80 | 20 | — | 14.164 | 5.993 |
| 60 | 40 | — | 17.014 | 6.710 |
| 40 | 60 | — | 21.145 | 7.513 |
| 20 | 80 | — | 108.240 | 9.120 |
| 80 | — | 20 | 13.252 | 5.652 |
| 60 | — | 40 | 15.034 | 5.986 |
| 40 | — | 60 | 87.918 | 6.353 |
| 20 | — | 80 | — | 28.162 |

The critical volume, where the viscosity increases rapidly is higher with petroleum derived middle distillate gas oil than with GTL. At 100° C. the viscosity is low. Such temperature dependence was already observed for the pure solvents in section Example 1. This is most likely associated with the formation of micelles at lower temperature that induce strong thickening upon cooling. At higher temperatures these structures can get disrupted, which keeps the solution at much lower viscosity.

EXAMPLE 4

Solubility of VI Improving Polymer in Gas Oil in Combination with Aromatic Hydrocarbons or Oxygenate The solubility of 10% w/w SV 150™ was tested in solvent mixtures comprising ShellSol A150 or FAME (RME) in combination with varying amounts of petroleum derived middle distillate gas oil.

Following mixing in the proportions shown in Table 8, the kinematic viscosity at 40° C. (VK 40, as measured by EN ISO 3104) and 100° C. (VK 100, as measured by EN ISO 3104) of the compositions was determined. The results are shown in Table 8.

TABLE 8

| Petroleum derived MD | FAME | Viscosity ($mm^2/s$) | |
|---|---|---|---|
| Gas Oil(% v/v) | (% v/v) | 40° C. | 100° C. |
| 30 | 70 | 298.130 | 58.087 |
| 40 | 60 | 321.880 | 57.441 |
| 50 | 50 | 388.520 | 56.333 |
| 60 | 40 | 755.050 | 58.155 |
| **Petroleum derived MD** | **ShellSolA150** | **Viscosity ($mm^2/s$)** | |
| **Gas Oil(% v/v)** | **(% v/v)** | **40° C.** | **100° C.** |
| 50 | 50 | 135.160 | 33.404 |
| 60 | 40 | 238.960 | 38.150 |
| 70 | 30 | 843.230 | 41.172 |
| 80 | 20 | Not measurable, with standard method - too high | 43.248 |

EXAMPLE 5

Solubility of VI Improving Polymer in Gas Oil, in Combination with Aromatic Hydrocarbons and Oxygenate A further optimisation of the solvent composition was achieved by preparation of different three-component blends containing 10% w/w of SV150™ and mixtures of petroleum derived middle distillate gas oil, ShellSol A150 and FAME (RME).

Following mixing in the proportions shown in Table 9, the kinematic viscosity at 40° C. (VK 40, as measured by EN ISO 3104) and 100° C. (VK 100, as measured by EN ISO 3104) of the compositions was determined. The results are shown in Table 9.

TABLE 9

| Petroleum derived MD | ShellSolA150 | FAME | Viscosity ($mm^2/s$) | |
|---|---|---|---|---|
| Gas Oil(% v/v) | (% v/v) | (% v/v) | 40° C. | 100° C. |
| 50 | 50 | 0 | 140.490 | 34.205 |
| 50 | 40 | 10 | 159.450 | 36.725 |
| 50 | 30 | 20 | 189.870 | 40.268 |
| 50 | 20 | 30 | 250.050 | 46.507 |
| 50 | 10 | 40 | 309.700 | 51.293 |
| 50 | 0 | 50 | 388.520 | 56.333 |
| 50 | 43 | 7 | 152.800 | 36.396 |
| 60 | 33 | 7 | 297.520 | 43.999 |
| 70 | 23 | 7 | 778.200 | 44.110 |

Up to 50% v/v of petroleum derived middle distillate could be mixed with FAME to keep the VK40 in a range up to about 400 $mm^2/s$. However such a solution cannot feasibly be blended into exchange base fuel, as it might become non compliant to EN590 due to addition of 0.5% FAME.

A mixture of 60% v/v petroleum derived middle distillate gas oil with ShellSolA150 gives an acceptable VK40 below 300 $mm^2/s$. Further addition of petroleum derived middle distillate gas oil results in a strong increase of VK40 starting at 70% v/v petroleum derived middle distillate gas oil.

What is claimed is:

1. An additive composition for blending with fuel, the additive composition comprising at least 3% w/w of a viscosity index (VI) improving polymer; and a solvent mixture comprising in the range of from 10 to 85% v/v of a middle distillate gas oil and at least 15% v/v of at least one component selected from aromatic hydrocarbons and oxygenates.

2. The additive composition of claim 1 wherein the solvent mixture comprises an aromatic hydrocarbon component having a boiling point in the range of 170 to 370° C.

3. The additive composition of claim 1 wherein an aromatic hydrocarbon component is present in the solvent mixture in an amount of 15 to 60% v/v based on the total volume of the solvent mixture.

4. The additive composition of claim 3 wherein the aromatic hydrocarbon component is present in the solvent mixture in an amount of 25 to 50% v/v based on the total volume of the solvent mixture.

5. The additive composition of claim 4 wherein the aromatic hydrocarbon component is present in the solvent mixture in an amount of 30 to 40% v/v based on the total volume of the solvent mixture.

6. The additive composition of claim 1 wherein the solvent mixture comprises an oxygenate component selected from fatty acid alkyl esters.

7. The additive composition of claim 1 wherein an oxygenate component is present in the solvent mixture in an amount of 2 to 60% v/v based on the total volume of the solvent mixture.

8. The additive composition of claim 7 wherein the oxygenate component is present in the solvent mixture in an amount of 3 to 25% v/v based on the total volume of the solvent mixture.

9. The additive composition of claim 8 wherein the oxygenate component is present in the solvent mixture in an amount of 4 to 10% v/v based on the total volume of the solvent mixture.

10. The additive composition of claim 1 wherein an oxygenate component is present at a concentration less than or equal to a concentration threshold associated with the oxygenate component in a fuel composition to which the additive composition is or is to be added.

11. The additive composition of claim 1 wherein the VI improving polymer comprises a block copolymer including an aromatic monomer.

12. The additive composition of claim 11 wherein the VI improving polymer comprises a polystyrene-polyisoprene di-block copolymer.

13. The additive composition of claim 1 wherein the middle distillate gas oil has a VK40, as measured by ENO ISO 3104, in the range of from 1.0 to 3.0 $mm^2/s$, and an aromatics content, as measured by IP391 or EN12916, in the range of from 15 to 30% m/m.

14. The additive composition of claim 1 comprising in the range of from 5 to 15% w/w of a VI improving copolymer, wherein the solvent mixture comprises 40 to 75% v/v middle distillate gas oil;

10 to 50% v/v aromatic hydrocarbons; and 3 to 10% v/v fatty acid alkyl esters, based on the total volume of the solvent mixture.

15. The additive composition of claim 1 wherein the composition has a kinematic viscosity at 40° C. of less than 400 $mm^2/s$.

16. A method of incorporating a VI improving polymer into a fuel composition, the method comprising: mixing at least 3% w/w of a VI improving polymer with a solvent mixture including in the range of from 10 to 85% v/v of a middle distillate gas oil and at least 15% v/v of one or more components selected from aromatic hydrocarbons and oxygenates to form an additive composition; and blending the additive composition with the fuel composition.

17. The method of claim 16 wherein the fuel composition and the additive composition each comprise a concentration of an oxygenate, with the concentration of the oxygenate in the additive being less than or equal to the concentration of the oxygenate in the fuel.

18. A fuel composition and additive composition package comprising: a fuel composition having a fuel component concentration or concentration threshold associated therewith; and an additive composition comprising: at least 3% w/w of a viscosity index (VI) improving polymer and a solvent mixture which comprises in a range of 10 to 85% v/v of a middle distillate gas oil and at least 15% v/v of one or more components selected from aromatic hydrocarbons and oxygenates and including a concentration of the fuel component, wherein the concentration of the fuel component in the additive composition is no greater than the concentration or concentration threshold associated with the fuel component in the fuel composition.

19. The additive composition of claim 14 wherein the VI improving copolymer comprises an aromatic monomer.

* * * * *